United States Patent [19]

Roesler et al.

[11] 4,211,406

[45] Jul. 8, 1980

[54] TABLE TENNIS NET HOLDER

[76] Inventors: Layton S. Roesler; Patricia I. Roesler, both of 3515 Mound, Ventura, Calif. 93003

[21] Appl. No.: 918,397

[22] Filed: Jun. 23, 1978

[51] Int. Cl.[2] ..... A63B 39/00

[52] U.S. Cl. ..... 273/30; 211/14

[58] Field of Search ..... 273/29 R, 30; 224/45 L

[56] References Cited

FOREIGN PATENT DOCUMENTS

| | | | |
|---|---|---|---|
| 984866 | 3/1976 | Canada | 273/30 |
| 851622 | 8/1952 | Fed. Rep. of Germany | 273/30 |
| 765866 | 6/1934 | France | 273/30 |
| 1052440 | 9/1953 | France | 273/30 |
| 7990 | of 1902 | United Kingdom | 273/30 |
| 691221 | 5/1953 | United Kingdom | 273/30 |

*Primary Examiner*—Richard C. Pinkham
*Assistant Examiner*—T. Brown
*Attorney, Agent, or Firm*—Jack C. Munro

[57] ABSTRACT

A table tennis net holder assembly in which there are a pair of net holding devices located in a spaced-apart manner with the net being stretched therebetween. Once the net is attached to the holding device, there should be no need to remove the net with the table tennis table not in use. Each net holding device moves from a stowage position adjacent the edge of the table tennis table to a extended position located substantially perpendicular to the edge of the table.

8 Claims, 4 Drawing Figures

TABLE TENNIS NET HOLDER

BACKGROUND OF THE INVENTION

Table tennis is a common indoor/outdoor sport which employs the use of a rectangularly shaped table of a particular size which has a net stretched in an upright manner across the center of the table. The normal type of brackets that are used to support the net are located directly adjacent the edge of the table which is not in full compliance with the rules of the game since the rules require that the net be stretched to a point six inches beyond the edge of the table.

Additionally, the original type of net holding bracket operated by means of a C-clamp which does not constitute a positive connection and is quite common for the net to become loose and does not maintain a taut position. When the table tennis table is not in use, it is common for one or both of the net holding devices to be removed from the table which then requires reinstallation prior to reuse of the table.

It would be most desirable to design a net supporting assembly in which the outer edges of the net were located at least six inches spaced outwardly from each edge of the table and also which would facilitate the location of the net in a tautly stretched position across the table and also located in a "down" position when the table is not in use. The net would remain attached to the net holding assembly at all times.

SUMMARY OF THE INVENTION

The table tennis net holding assembly of this invention is to achieve the aforementioned objectives by being constructed of few parts simply interconnected together in a novel manner.

The net holding assembly of this invention comprises a pair of net holders with one of the net holders to be fixedly mounted to one edge of the table tennis table and the other net holder being fixedly mounted to the opposite lateral edge of the table tennis table. Each net holder includes an extension plate which is pivotly mounted to the attaching plate which is fixed to the edge of the table. The extension plate is pivotable from a stowed position adjacent the edge of the table to an extended position which supports the net in a tightly stretched position across the table. The net is attached to an upstanding arm which is pivotly mounted with respect to the extension plate adjacent the outer edge thereof. The upstanding arm is to be pivotable to a longitudinal, in-line position with the extension plate when the extension plate is located in a stowage position. Each holder is to include a table tennis ball holder. A latching means is employed to fix the position of the extension plate with respect to its attaching plate when the extension plate is in the extended or net supporting position. The upstanding arm is to be adjustable longitudinally with respect to the extension plate.

DETAILED DESCRIPTION OF THE SHOWN EMBODIMENT

Figure 1:
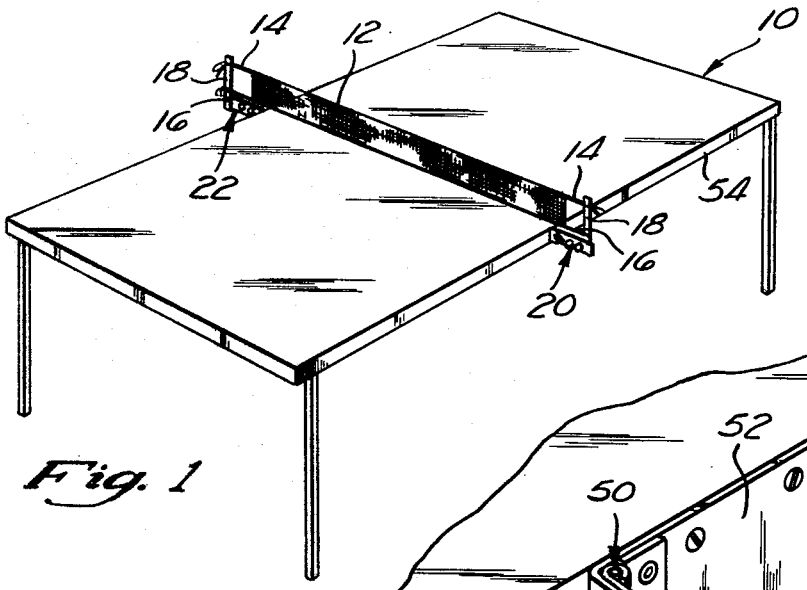
FIG. 1 is an isometric view of a typical table tennis table in which the net is stretched tautly across the table and supported by the holder assembly of this invention.

Referring specifically to the drawing there is shown in FIG. 1 a conventional table tennis table 10 which has stretched thereacross a table tennis net 12. The net 12 at each end thereof has an upper attaching string 14 and a lower attaching string 16. One pair of strings 14 and 16 are to be attached to an upstanding arm 18 of one holder 20 while the other pair of attaching strings 14 and 16 are attached to an upstanding arm 18 of holder 22. It is to be understood that the holders 20 and 22 are basically identical to each other but only are located in a mirror image relationship. In essence, the holder 20 is a right handed holder with the holder 22 constituting a left handed holder. In the manufacture, the holders 20 and 22 are constructed identically with the exception that the upstanding arm 18 is mounted slightly differently upon its extension plate 24. In reference to FIG. 2 of the drawing, the upstanding arm 18 is adjustably mounted through use of a wing nut fastener assembly 26 which operates in conjunction with a slot 28. The upstanding arm 18 is reversed when used as a left handed holder. The arm 18 is locked in position by flange 30 which is positioned under lower edge of plate 34 and also notch 56 which abuts the upper edge of plate 24.

It is to be understood that all the parts of each holder 20 and 22 of this invention are composed primarily of sheet metal. However, any sheet type of material of construction could be readily employed.

The attaching string 14 of the net is tied around the upper end of the upstanding arm 18 and cooperates with a notch 32. This facilitates the fixing in position of the upper edge surface of the net 12 which is desirable to be maintained during play. The lower attaching string 16 is merely slidable upon the arm 18 so that the tautness of the net 12 can be adjusted in height.

The extension plate 24 includes a pair of spaced-apart openings 34 and 36. The openings 34 and 36 are to be capable of connecting with a table tennis balls 38 and 40. The table tennis balls 38 and 40 are to be maintained in cooperation with the respective openings 34 and 36 by means of a leaf spring clamp member 42. The member 42 is fixedly mounted to the extension plate 24.

A C-clamp member 44 is slidably mounted on the extension plate 24. The member 44 functions to fixedly locate the extension plate 24 in the net supporting position by sliding over the flange 48. The flange 48 functions as a stop to limit the movement of the extension plate.

The extension plate 24 is pivotly mounted by means of a conventional hinge assembly 50 to an attaching plate 52. The attaching plate is fixedly secured to the edge 54 of the table tennis table 10.

Figure 2:
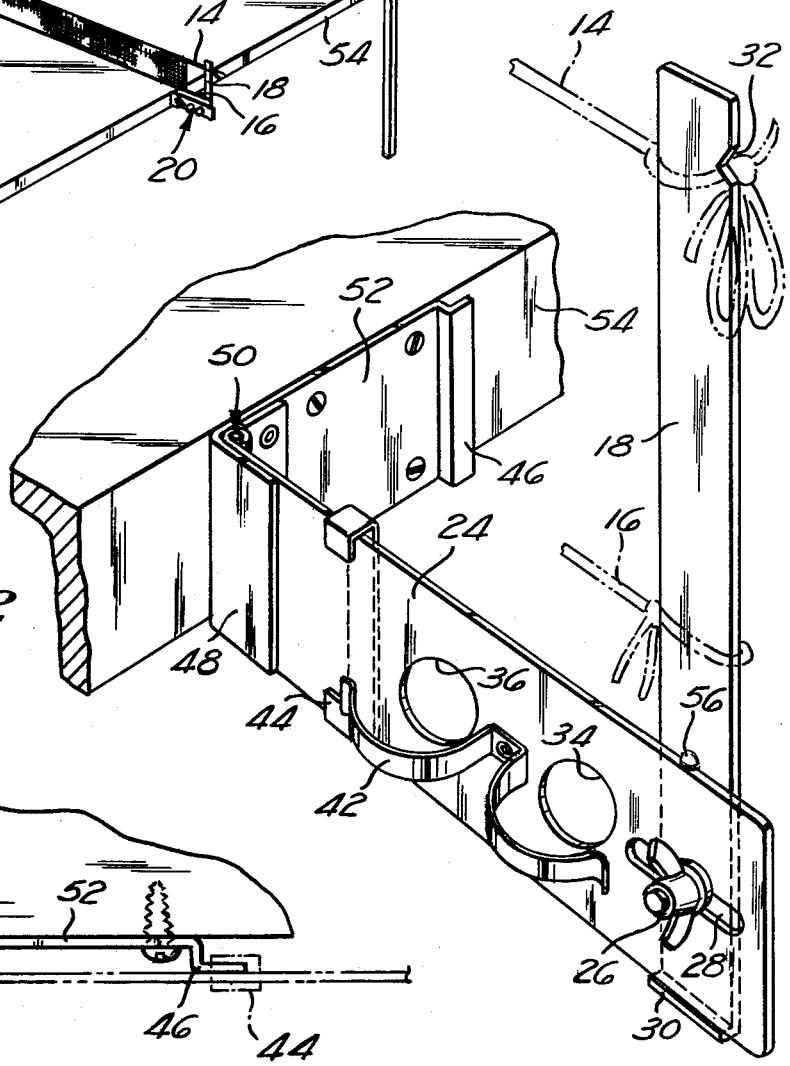
FIG. 2 is an enlarged view of one of the holders within the net supporting assembly of this invention showing such in the net supporting position.
Figure 3:
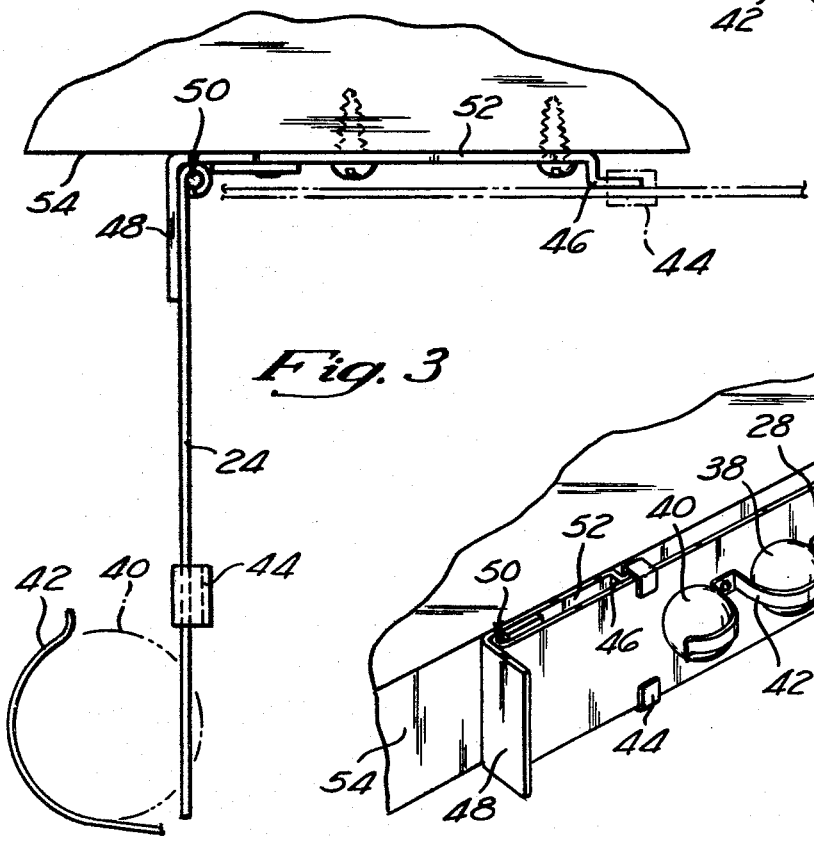
FIG. 3 is a top plan view of a portion of the holder of FIG. 2 showing the movement of the holder between the extended position and the stowage position.
Figure 4:
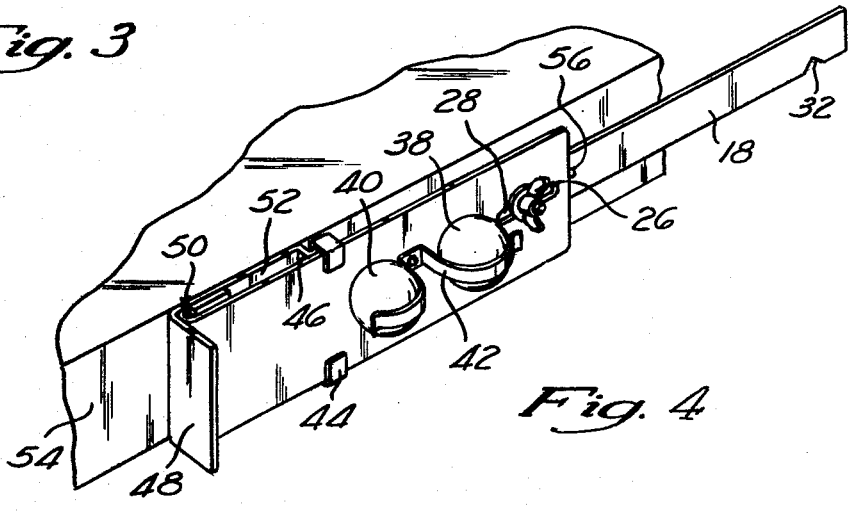
FIG. 4 is an isometric view of the holder of FIG. 2 showing such in a stowage position.

From the net supporting position shown in FIGS. 2 and 3 of the drawings, a person may merely manually pivot the extension plate 24 to the stowed position showed in phantom lines within FIG. 3. In such movement of the extension plate 24, the C-clamp member 44 is disengaged from flange 48. In this position the upstanding arm 18 may be moved so that its longitudinal center axis would be located parallel to the longitudinal center axis of the extension plate 24. This position is shown within FIG. 4 of the drawing. In this stowed position, the net 12 will normally be resting against the top surface of the table 10. The C-clamp member 44 is then to slide over flange 46 of plate 52 to lock the holder 20 or 22 in the stowed position.

To relocate the holder 20 or 22 in the position for supporting the net 12, the operator first moves each upstanding arm 18 to the upright position. In this position the wing nut assembly 26 is tightened thereby fixing the upstanding arm 18 with respect to the extension plate 24. The operator then pivots the extension plate 24 until such is in abutting contact with the flange 48. A net 12 should now be supported in a taut manner across the surface of the table 10 and ready for use.

What is claimed is:

1. A table tennis net holder comprising:

an attaching plate adapted to be secured to the side edge of a table tennis table;

an extension plate having an inner end and an outer end, said inner end being connected to said attaching plate, said extension plate having a first longitudinal center axis, said extension plate being pivotable in respect to said attaching plate from a stowage position directly adjacent said attaching plate to a net supporting position approximately ninety degrees displaced from said stowage position;

an upstanding arm connected by connecting means to said extension plate at said outer end, said upstanding arm having a second longitudinal center axis, said second longitudinal center axis to be located approximately ninety degrees to said first longitudinal center axis with said extension plate in said net supporting position, said upstanding arm to be connectable to a table tennis net; and said upstanding arm being adjustably mounted in respect to said extension plate by adjustment means so as to vary the established position of said upstanding arm in a direction along said first longitudinal center axis, said adjustment means being movable to fix said upstanding arm in an established position, and locking means connected to said upstanding arm for locking said upstanding arm in said established position.

2. A table tennis net holder as defined in claim 1 wherein:

first stop means fixedly connected to said attaching plate to limit the movement of said extension plate in contact with said stop means.

3. A table tennis net holder as defined in claim 2 wherein:

said first stop means comprises a flange which extends substantially at a right angle therefrom.

4. A table tennis net holder as defined in claim 3 including:

latching means, interconnecting said extension plate and said flange to fix said net supporting position and prevent accidental movement of said extension plate from the said net supporting position.

5. The table tennis net holder as defined in claim 1 wherein:

said connecting means permitting pivoting movement of said upstanding arm in respect to said extension plate, said upstanding arm being pivotable between a retracted position and said net supporting position, with said upstanding arm in said retracted position the said second longitudinal center axis being substantially parallel to said first longitudinal center axis.

6. The table tennis net holder as defined claim 5 wherein:

first stop means fixedly connected to said attaching plate to limit the movement of said extension plate and to define said net supporting position with said extension plate in contact with said stop means, said first stop means comprises a flange which extends substantially at a right angle therefrom; and said locking means comprises a second stop means located between said upstanding arm and said extension plate to fixedly establish the position of said upstanding arm when in said net supporting position.

7. The table tennis net holder as defined in claim 6 wherein:

latching means interconnecting said extension plate and said flange to fix said net supporting and prevent accidental movement of said extension plate from the said net supporting position.

8. A table tennis net holder comprising:

an attaching plate adapted to be secured to the side edge of a table tennis table;

an extension plate having an inner end and an outer end, said inner end being connected to said attaching plate, said extension plate having a first longitudinal center axis, said extension plate being pivotable in respect to said attaching plate from a stowage position directly adjacent said attaching plate to a net supporting position approximately ninety degrees displaced from said stowage position;

an upstanding arm connected by connecting means to said extension plate at said outer end, said upstanding arm having a second longitudinal center axis, said second longitudinal center axis to be located approximately ninety degrees to said first longitudinal center axis with said extension plate in said net supporting position, said upstanding arm to be connectable to a table tennis net; and table tennis ball holding means mounted on said extension plate.

* * * * *